US008015840B2

(12) United States Patent
Oh et al.

(10) Patent No.: US 8,015,840 B2
(45) Date of Patent: Sep. 13, 2011

(54) REFRIGERATOR

(75) Inventors: Jong Hak Oh, Gwangiu (KR); Chun Young Oh, Gwangiu (KR); Sang Soo Kim, Gwangiu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 690 days.

(21) Appl. No.: 11/392,502

(22) Filed: Mar. 30, 2006

(65) Prior Publication Data

US 2007/0113576 A1 May 24, 2007

(30) Foreign Application Priority Data

Nov. 22, 2005 (KR) ..... 10-2005-0111901

(51) Int. Cl.
*F25D 11/00* (2006.01)

(52) U.S. Cl. ..... 62/440; 62/447

(58) Field of Classification Search ..... 62/440, 62/447, 451, 296; 181/200, 175, 209; 96/380
See application file for complete search history.

(56) References Cited

U.S. PATENT DOCUMENTS 3,813,137 A * 5/1974 Fellwock et al. ..... 312/406.1
3,858,409 A * 1/1975 Besing ..... 62/285
4,498,713 A * 2/1985 Fellwock et al. ..... 312/406.1
5,403,062 A * 4/1995 Sjostedt et al. ..... 296/181.3

FOREIGN PATENT DOCUMENTS

KR 10-2004-0067649 7/2004

OTHER PUBLICATIONS

Kipp, Dale O. (2004). Plastic Material Data Sheets. MatWeb—Division of Automation Creation, Inc.; Online version available at: http://knovel.com/web/portal/browse/display?_EXT_KNOVEL_DISPLAY_bookid=1023&VerticalID=0).*

Chinese Office Action issued with respect to Chinese Patent Application No. 200610074708.7, which corresponds to the above-referenced application.

* cited by examiner

*Primary Examiner* — Mohammad Ali
(74) *Attorney, Agent, or Firm* — Staas & Halsey LLP

(57) ABSTRACT

A refrigerator which includes an outer case defining the outer appearance of the refrigerator, the inner case received in the outer case and defining a storage compartment, the insulation member filled in a gap between the outer case and the inner case for heat insulation, and a noise attenuation member disposed between an outer surface of the inner case and the insulation member to induce a sliding movement between the inner case and the insulation member. The insulation member is slidable relative to the insulation member when the inner case expands or contracts in accordance with a variation of temperature, whereby the generation of frictional noise due to friction between the inner case and the insulation member can be greatly reduced.

6 Claims, 5 Drawing Sheets

REFRIGERATOR

CROSS-REFERENCE TO RELATED APPLICATIONS

This application claims the benefit of Korean Patent Application No. 10-2005-0111901, filed on Nov. 22, 2005 in the Korean Intellectual Property Office, the disclosure of which is incorporated herein by reference.

BACKGROUND OF THE INVENTION

1. Field of the Invention

The present invention relates to a refrigerator. More particularly, to a refrigerator which can reduce generation of frictional noise between an insulation member and an inner case of the refrigerator, when the inner case is thermally deformed (i.e. expands or contracts in accordance with a variation of temperature).

2. Description of the Related Art

Generally, a conventional refrigerator generates cool air from an evaporator of a refrigeration cycle of the refrigerator, and the cool air is supplied into a storage compartment of the refrigerator, whereby the freshness of various food reserves stored in the storage compartment can be maintained for a long time.

Korean Patent Laid-Open Publication No. 2004-67649 discloses a conventional refrigerator which includes an outer case defining the outer appearance of a refrigerator body, an inner case received in the outer case and defining a storage compartment, and an insulation member filled in a gap between the outer case and the inner case for heat insulation. An evaporator is mounted in a rear region of the inner case and is adapted to cool air inside the storage compartment via heat exchange with the interior air of the storage compartment.

The evaporator is normally maintained at an extremely low temperature to cool the interior air of the storage compartment. However, when it is desired to defrost the surface of the evaporator in use, the evaporator has to be heated by use of a heater or high-temperature refrigerant. Thus, the evaporator often exhibits huge temperature variation.

When the evaporator is heated by use of the heater or high-temperature refrigerant for defrosting purposes, or the evaporator is returned to a low temperature after completion of defrosting, the temperature of the evaporator has a direct affect on a certain portion of the inner case adjacent to the evaporator. The affected portion of the inner case may expand or contract while exhibiting a huge temperature rise or drop. On the other hand, the insulation member, which comes into close contact with an outer surface of the inner case, is made of a low heat conductivity material, such as urethane, for heat insulation, and therefore, exhibits less temperature variation, resulting in little heat deformation including expansion and contraction.

Accordingly, when the inner case exhibits a huge temperature variation, for example, when the evaporator is heated for defrosting or is cooled via the supply of a low-temperature refrigerant thereinto after completion of defrosting, friction may be generated between the insulation member, which experiences little expansion or contraction, and the outer surface of the inner case which expands or contracts. As a result, the disclosed conventional refrigerator suffers from the generation of frictional noise between the inner case and the insulation member.

SUMMARY OF THE INVENTION

Accordingly, it is an aspect of the present invention to provide a refrigerator which can reduce friction and frictional noise between an inner case and an insulation member when the inner case is thermally deformed (i.e. expands or contracts in accordance with a variation of temperature).

Additional aspects and/or advantages of the invention will be set forth in part in the description which follows and, in part, will be apparent from the description, or may be learned by practice of the invention.

The foregoing and/or other aspects of the present invention are achieved by providing a refrigerator including an outer case, an inner case received in the outer case and defining a storage compartment, an insulation member filled in a gap between the outer case and the inner case for heat insulation, and a noise attenuation member disposed between an outer surface of the inner case and the insulation member to induce a sliding movement between the inner case and the insulation member when the inner case expands or contracts in accordance with a variation of temperature, thereby reducing frictional noise due to friction between the inner case and the insulation member.

The refrigerator further includes an evaporator disposed in the inner case to cool air inside the storage compartment via a heat exchange with the interior air of the storage compartment, and the noise attenuation member is attached to a portion of the inner case adjacent to the evaporator.

Further, the inner case is formed at a rear surface thereof and includes a rearwardly-dented receiving portion to receive the evaporator, and the noise attenuation member is attached to an outer surface of the receiving portion.

The noise attenuation member includes a shape layer which is deformed to a shape corresponding to a location, where the noise attenuation member is attached, and maintains the deformed shape, an adhesive layer provided at one side of the shape layer to allow the noise attenuation member to be strongly attached to the inner case, and a slip layer provided at the other opposite side of the shape layer to come into contact with the insulation member, wherein the slip layer includes a low frictional coefficient to achieve a smooth sliding movement between the insulation member and the inner case.

It is another aspect of the present invention to provide a refrigerator including an outer case, an inner case received in the outer case and defining a storage compartment, an insulation member filled in a gap between the outer case and the inner case for heat insulation, and a noise attenuation member including a first surface attached to an outer surface of the inner case and an opposite second surface having a low frictional coefficient to slide on the insulation member, thereby inducing a sliding movement between the outer surface of the inner case and the insulation member when the inner case is thermally deformed in accordance with a variation of temperature.

It is yet another aspect of the present invention to provide a refrigerator including an outer case, an inner case received in the outer case and defining a storage compartment, an insulation member filled in a gap between the outer case and the inner case, and a noise attenuation member disposed between the inner case and the insulation member, wherein the noise attenuation member being slidable relative to the insulation member.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
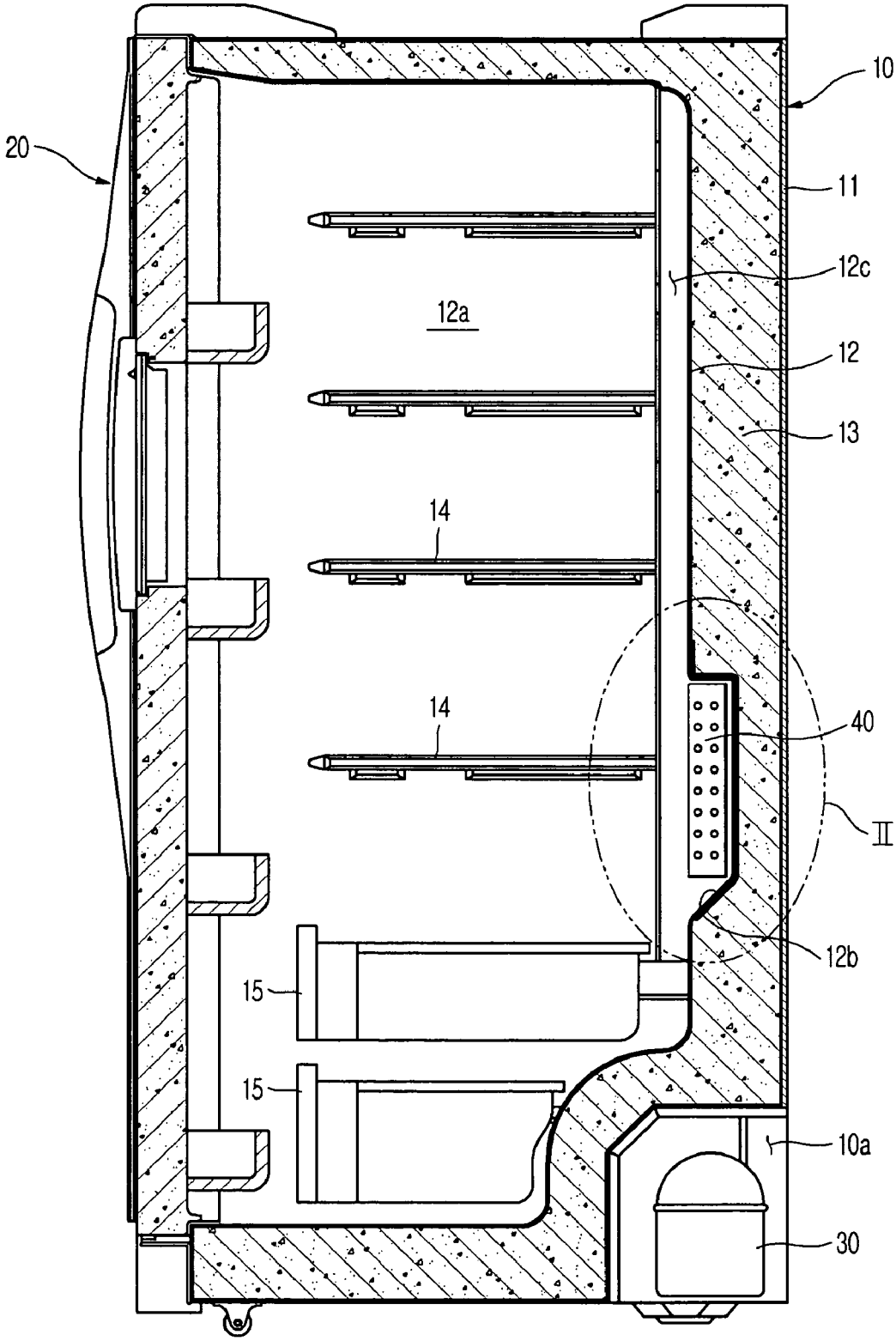
FIG. 1 is a sectional view illustrating a refrigerator according to an embodiment of the present invention.

Reference will now be made in detail to an embodiment of the present invention, examples of which are illustrated in the accompanying drawings, wherein like reference numerals refer to like elements throughout. The embodiment is described below to explain the present invention by referring to the figures.

In FIG. 1, a refrigerator according to an embodiment of the present invention is illustrated in sectional view. As shown in FIG. 1, the refrigerator comprises an outer case 11 defining the outer appearance of a body 10; an inner case 12 received in the outer case 11 and defining a storage compartment 12*a* for the preservation of food reserves, and an insulation member 13 filled in a gap between the outer case 11 and the inner case 12, the insulation member 13 being made of urethane for heat insulation.

Both the outer case 11 and the inner case 12 have open front sides to put or take food reserves into or out of the storage compartment 12*a*. A door 20 is coupled with an edge of the front surface of the body 10 by use of hinges, such that the door 20 is pivotally rotatable to open or close the storage compartment 12*a*.

The body 10 of the refrigerator includes constituent elements of a refrigeration cycle, for example, a compressor 30 to compress a refrigerant to a high-temperature and high-pressure state, a condenser (not shown) to cool the refrigerant via heat exchange with air, an expander (not shown) such as a capillary tube, to decompress and expand the refrigerant, and an evaporator 40 to cool air inside the storage compartment 12*a* via heat exchange with the interior air of the storage compartment 12*a*.

A machine room 10*a* is provided beneath the body 10 such that the compressor 30, condenser, and capillary tube of the refrigeration cycle are mounted. The inner case 12 is formed at a rear surface thereof with a rearwardly dented receiving portion 12*b* for the installation of the evaporator 40.

A plurality of shelves 14 and receiving containers 15 are provided in the storage compartment 12*a*, such that various kinds of food reserves can be separately stored. A cool air path 12*c* is defined in a rear region of the storage compartment 12*a*, such that the air, cooled by the evaporator 40, is distributed and supplied from the evaporator 40 upward and downward, to evenly cool food reserves of the respective shelves 14 and receiving containers 15. A cooling fan (not shown) is disposed at a certain location of the cool air path 12*c*, such that the air of the storage compartment 12*a* circulates through the cool air path 12*c* to be heat exchanged in the evaporator 40.

Figure 2:
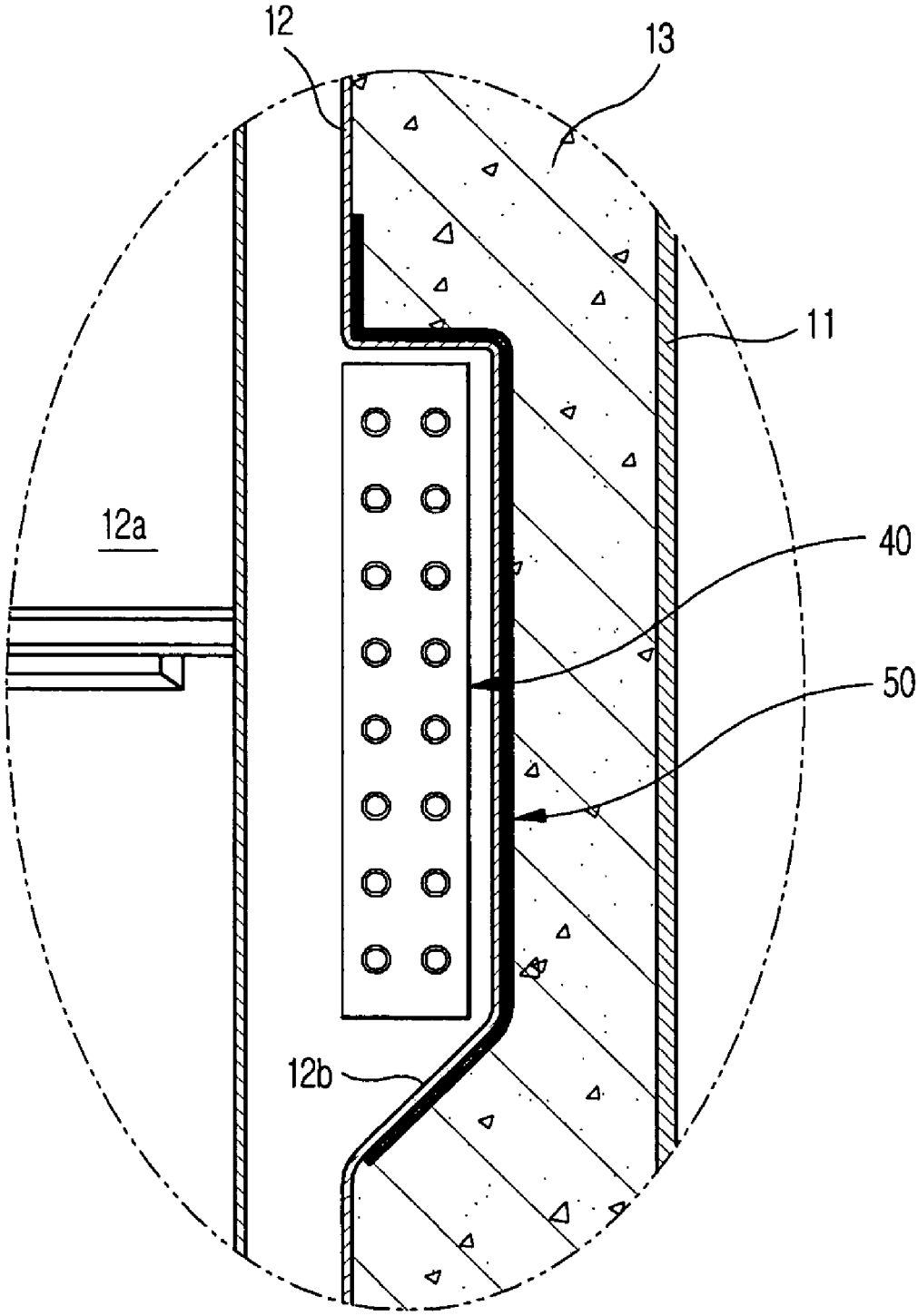
FIG. 2 is an enlarged sectional view of the portion II of FIG. 1.

FIG. 2 is an enlarged sectional view of the portion II of FIG. 1. In FIG. 2, the refrigerator according to an embodiment of the present invention, is provided with a noise attenuation member 50. The noise attenuation member 50 serves to prevent friction between the inner case 12 and the insulation member 13 when the evaporator 40 is heated to a high temperature for defrosting thereof. Consequently, the noise attenuation member 50 is able to prevent the generation of frictional noise between the inner case 12 and the insulation member 13.

The noise attenuation member 50 is disposed between an outer surface of the inner case 12 and the insulation member 13. Specifically, a surface of the noise attenuation member 50 is attached to the outer surface of the inner case 12, while the other opposite surface comes into contact with the insulation member 13. With this configuration, the noise attenuation member 50 is able to induce a sliding movement between the insulation member 13 and the inner case 12, thereby reducing friction and frictional noise between the insulation member 13 and the inner case 12. The evaporator 40 is mounted in the receiving portion 12*b* formed at the rear surface of the inner case 12. Thus, when the evaporator 40 exhibits a huge temperature variation, the receiving portion 12*b* will be thermally deformed. In the present embodiment, the noise attenuation member 50 is attached to an outer surface of the receiving portion 12*b* of the inner case 12, to reduce friction between the outer surface of the receiving portion 12*b* and the insulation member 13.

Figure 3:
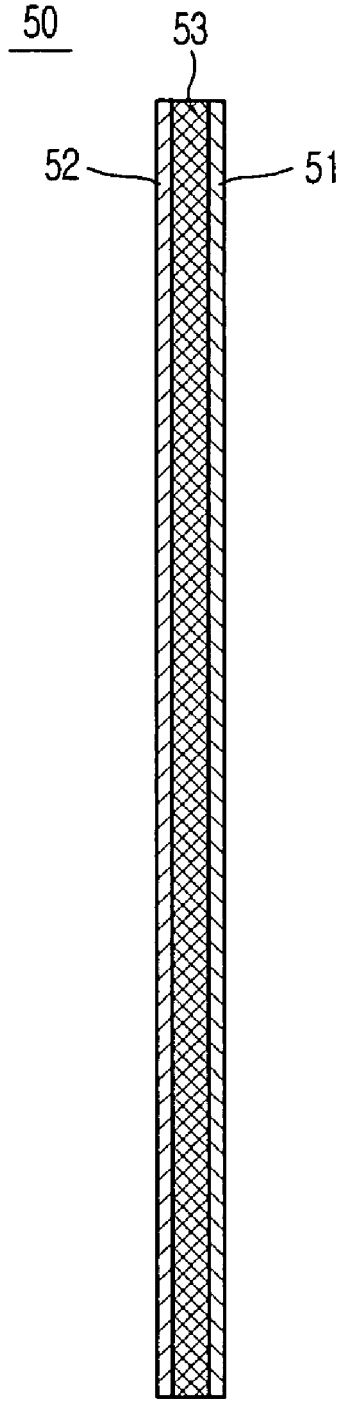
FIG. 3 is a sectional view illustrating a noise attenuation member for use in the refrigerator of FIG. 1.

To reduce friction and frictional noise between the outer surface of the inner case 12 and the insulation member 13, as shown in FIG. 3, the noise attenuation member 50 includes an adhesive layer 51, which forms one surface of the noise attenuation member 50 that is attached to the outer surface of the inner case 12. The adhesive layer 51 allows the noise attenuation member 50 to be continuously attached to the outer surface of the inner case 12. Also, the noise attenuation member 50 comprises a slip layer 52, which forms the other opposite surface of the noise attenuation member 50 that comes into contact with the insulation member 13. The slip layer 52 is made of a material having a low frictional coefficient, thereby allowing a smooth sliding movement between the noise attenuation member 50 and the insulation member 13. Since the insulation member 13 is formed by injecting and foaming molten high-temperature urethane between the outer case 11 and the inner case 12 it is preferable that the slip layer 52 is made of a heat-resistant material.

The noise attenuation member 50 further comprises a shape layer 53 between the adhesive layer 51 and the slip layer 52. The shape layer 53 is easily deformable to a shape corresponding to a portion where the noise attenuation member 50 is attached and to continuously maintain the deformed shape. In accordance with an aspect of the present embodiment, the shape layer 53 is made of a paper sheet having a predetermined thickness. The shape layer 53 is able to be deformed to a shape corresponding to the receiving portion 12*b*, such that the noise attenuation member 50 tightly encloses the outer surface of the receiving portion 12*b*.

Hereinafter, an operation of the refrigerator of an embodiment of the present invention will be explained.

When the evaporator 40 is heated by use of a heater (not shown) or a high-temperature refrigerant for defrosting thereof, the temperature of the receiving portion 12*b*, which is formed at the inner case 12 to receive the evaporator 40, rises in accordance with the temperature rise of the evaporator 40. Thereby, the receiving portion 12*b* of the inner case 12 expands. Conversely, if a low-temperature refrigerant is supplied into the evaporator 40 after completion of defrosting to cool the storage compartment 12*a*, the temperature of the evaporator 40 drops greatly, causing the temperature drop of the receiving portion 12*b* that receives the evaporator 40. Thereby, the receiving portion 12*b* of the inner case 12 contracts.

When the receiving portion 12*b* is thermally deformed (i.e. expands or contracts in accordance with the temperature variation of the evaporator 40), the insulation member 13, located at the outside of the receiving portion 12*b*, has little expansion or contraction since it has a low heat conductivity and thus exhibits less temperature variation. Thereby, only the receiving portion 12*b* of the inner case 12 moves slightly along the surface of the insulation member 13 via expansion or contraction thereof.

The noise attenuation member 50 is attached to the outer surface of the receiving portion 12*b* of the inner case 12, such that the insulation member 13 comes into contact with the slip layer 52 of the noise attenuation member 50 having a low frictional coefficient. Accordingly, the noise attenuation member 50 induces a sliding movement between the outer surface of the inner case 12 and the insulation member 13, resulting in a reduction of friction between the outer surface of the inner case 12 and the insulation member 13.

Figure 4:
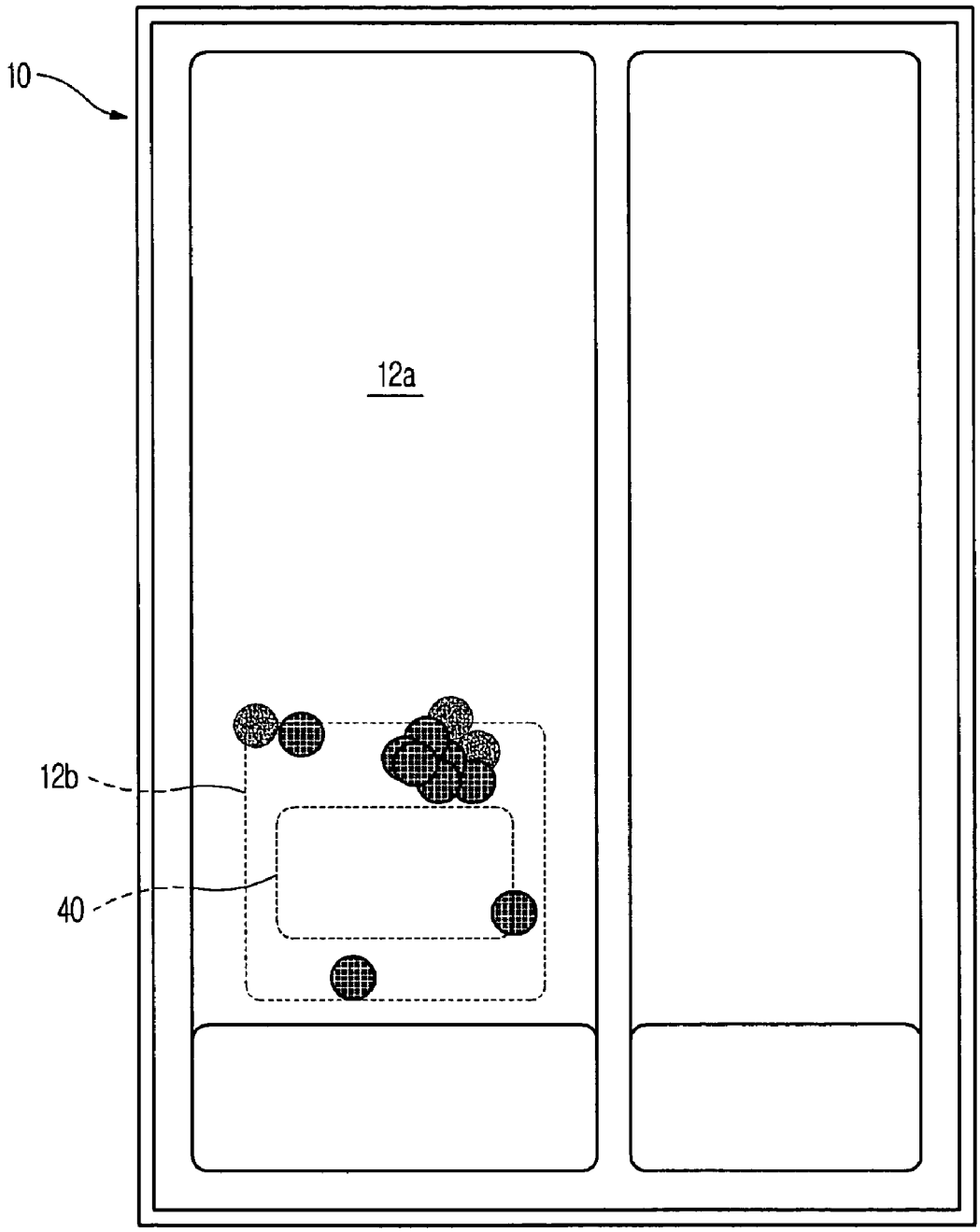
Fig.4 PRIOR ART
FIG. 4 is a schematic view illustrating the occurrence frequency and distribution of noise generated in a conventional refrigerator.
Figure 5:
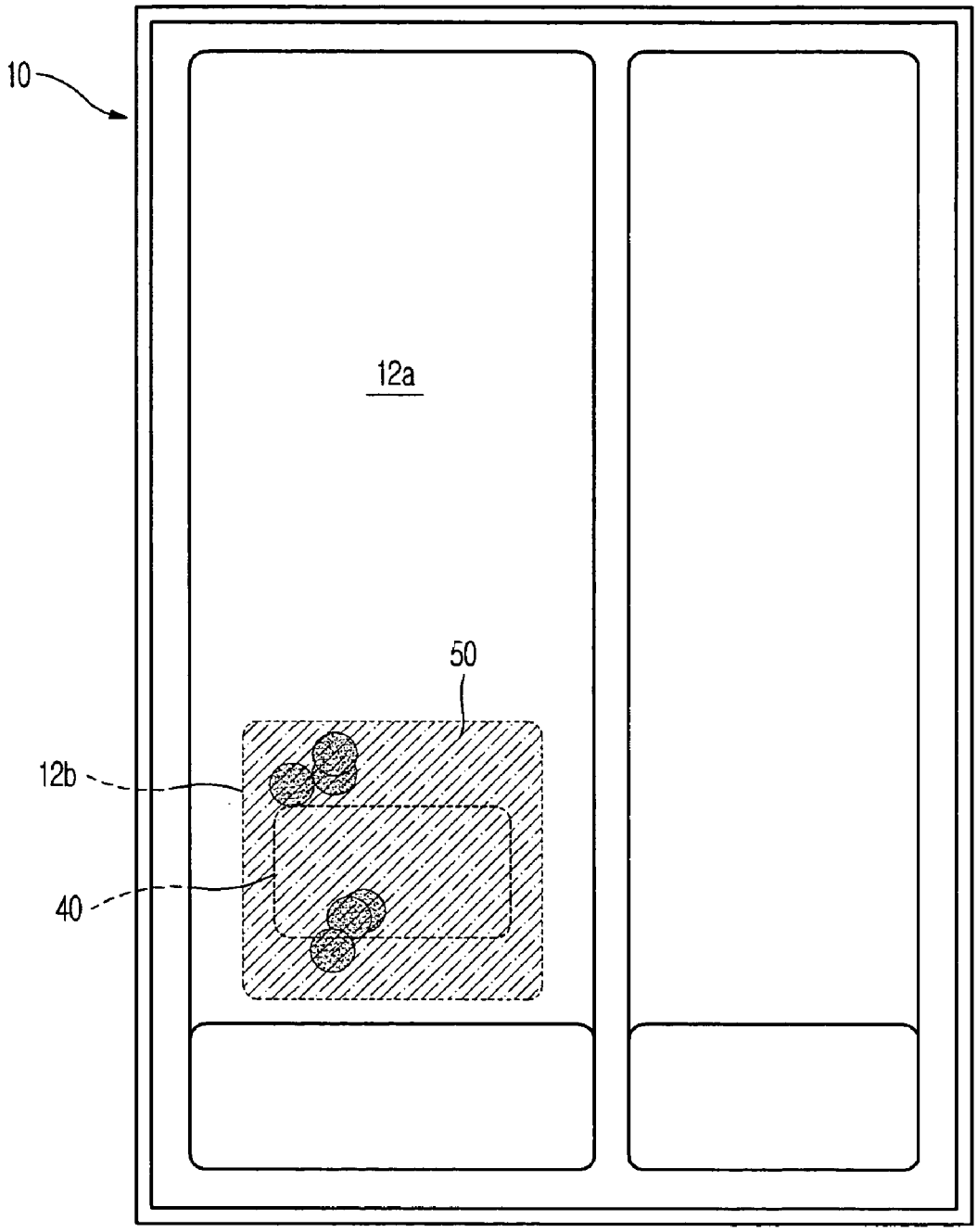
FIG. 5 is a schematic view illustrating the occurrence frequency and distribution of noise generated in the refrigerator according to an embodiment of present invention.

FIG. 4 illustrates a conventional refrigerator, and the distribution of frictional noise, which is measured via an experiment performed on the receiving portion 12*b* without the noise attenuation member 50. FIG. 5 illustrates a refrigerator according to an embodiment and the distribution of frictional noise, which is measured via an experiment performed on the receiving portion 12*b* provided with the noise attenuation member 50. In FIGS. 4 and 5, circles indicate noise occurrence positions, respectively. The darker the color of the circle, it indicates the strength of noise generated is higher.

As will be understood by comparing the number and color of the circles shown in FIGS. 4 and 5, the refrigerator according to an embodiment of the present invention shows that the occurrence frequency and strength of noise are greatly reduced and lowered as compared to a conventional refrigerator.

Also, as a result of measuring the occurrence frequency of noise, assuming that a period from a time when the evaporator 40 begins to cool the storage compartment 12*a* to a time when the temperature of the storage compartment 12*a* reaches a preset temperature is one cycle, it has been found that the conventional refrigerator exhibits a noise generation rate of 0.66/cycle, whereas the refrigerator consistent with the present invention exhibits a noise generation rate of 0.26/cycle, achieving a considerable reduction in the occurrence frequency of noise.

As apparent from the above description, the present invention provides a refrigerator wherein a noise attenuation member is disposed between the outer surface of an inner case and an insulation member to induce a sliding movement between the inner case and the insulation member. With the use of the noise attenuation member, even when the inner case is thermally deformed (i.e. expands or contracts in accordance with a temperature variation), exhibiting a change in length thereof, it is possible to reduce friction between the outer surface of the inner case and the insulation member by virtue of the sliding movement therebetween. As a result, the present invention has the effect of achieving a great reduction in frictional noise between the outer surface of the inner case and the insulation member.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

an outer case defining an outer appearance of the refrigerator;

an inner case received in the outer case and defining a refrigerated storage compartment;

an insulation member filled in a gap between the outer case and the inner case for heat insulation;

a layered noise attenuation member disposed between an outer surface of the inner case and the insulation member to induce a sliding movement between the inner case and the insulation member when the inner case expands or contracts in accordance with a variation of temperature, thereby reducing frictional noise due to friction between the inner case and the insulation member; and an evaporator disposed in the inner case to cool air inside the storage compartment via heat exchange with the interior air of the storage compartment, and wherein the noise attenuation member is attached to a portion of the inner case adjacent to the evaporator;

wherein the inner case is formed at a rear surface of the refrigerator and comprises a rearwardly-dented receiving portion to receive the evaporator, and the noise attenuation member is attached on a rear outer surface of the receiving portion and configured to substantially follow an outward contour of an entire rear portion of the evaporator.

2. A refrigerator comprising:

an outer case defining an outer appearance of the refrigerator;

an inner case received in the outer case and defining a refrigerated storage compartment;

an insulation member filled in a gap between the outer case and the inner case for heat insulation;

a layered noise attenuation member comprising a first layer including a first surface attached to an outer surface of the inner case, and a second layer having an opposite second surface having a low frictional coefficient to slide on the insulation member, thereby inducing a sliding movement between the outer surface of the inner case and the insulation member when the inner case is thermally deformed in accordance with a variation of temperature; and an evaporator disposed in the inner case to cool air inside the storage compartment via heat exchange with the interior air of the storage compartment, and wherein the noise attenuation member is attached to a portion of the inner case adjacent to the evaporator, wherein the inner case is formed at a rear surface of the refrigerator, and comprises a rearwardly-dented receiving portion to receive the evaporator, and wherein the noise attenuation member is attached on a rear outer surface of the receiving portion and configured in shape and length to substantially follow an outward contour of an entire rear portion of the evaporator.

3. The refrigerator according to claim 2, wherein the first surface of the noise attenuation member is a surface of an adhesive layer to allow the noise attenuation member to be strongly attached to the inner case, and the second surface of the noise attenuation member is a surface formed of a slip layer having a low frictional coefficient contacting with the insulation member, to induce a smooth sliding movement between the insulation member and the inner case.

4. A refrigerator comprising:

an outer case defining an outer appearance of the refrigerator;

an inner case received in the outer case and defining a refrigerating storage compartment;

an insulation member filled in a gap between the outer case and the inner case;

an evaporator; and a noise attenuation member disposed between the inner case and the insulation member, wherein the noise attenuation member is slidable relative to the insulation member and comprises an adhesive first layer, a second layer, and a third slip layer, the noise attenuation member being adjacent to and substantially configured in shape and length to follow a contour of an entire rear portion of the evaporator.

5. The refrigerator according to claim 4, wherein the evaporator is disposed in the inner case to cool air inside the storage compartment via heat exchange with interior air of the storage compartment, and wherein the noise attenuation member is attached to a portion of the inner case adjacent to the evaporator.

6. A refrigerator comprising:

an outer case defining an outer appearance of the refrigerator;

an inner case positioned within the outer case and defining a refrigerating storage compartment of the refrigerator and comprising a recess therein to house an evaporator of the refrigerator;

insulation material disposed between the outer case and the inner case; and a noise attenuation member positioned on an outer surface of the recess of the inner case contacting the insulation material, and of a shape corresponding to a shape of the recess, to reduce frictional noise due to friction between the inner case and the insulation member, the noise attenuation member being adjacent to and substantially configured to follow in shape and length a contour of an entire rear portion of the evaporator, the noise attenuation member comprising:

an adhesive layer to attach the noise attenuation member to the outer surface of the recess; and a slip layer contacting with the insulation material to allow a sliding movement between the noise attenuation member and the insulation material.

* * * * *

UNITED STATES PATENT AND TRADEMARK OFFICE

CERTIFICATE OF CORRECTION

PATENT NO. : 8,015,840 B2
APPLICATION NO. : 11/392502
DATED : September 13, 2011
INVENTOR(S) : Oh et al.

It is certified that error appears in the above-identified patent and that said Letters Patent is hereby corrected as shown below:

Title Page, Item (75)

Column 1 (Inventors), Line 1, Delete “Gwangiu” and insert -- Gwangju --, therefor.

Column 1 (Inventors), Line 2, Delete “Gwangiu” and insert -- Gwangju --, therefor.

Column 1 (Inventors), Line 3, Delete “Gwangiu” and insert -- Gwangju --, therefor.

Signed and Sealed this
Seventh Day of February, 2012

David J. Kappos

David J. Kappos
*Director of the United States Patent and Trademark Office*